US005255419A

United States Patent [19]

Stanislaw et al.

[11] Patent Number: 5,255,419

[45] Date of Patent: Oct. 26, 1993

[54] TENTERING APPARATUS AND METHOD

[75] Inventors: Peter P. Stanislaw, Bennington, Vt.; Sadao Yagi, Pittsfield, Mass.

[73] Assignee: Morrison Berkshire, Inc., North Adams, Mass.

[21] Appl. No.: 658,006

[22] Filed: Feb. 20, 1991

[51] Int. Cl.[5] ..... D06C 3/02

[52] U.S. Cl. ..... 26/89; 26/74; 26/84; 26/91; 26/92

[58] Field of Search ..... 26/51, 52, 53, 71, 74, 26/88, 87, 89, 91, 80, 90, 92, 88, 89, 76, 77, 78, 81, 84

[56] References Cited

U.S. PATENT DOCUMENTS

| | | | |
|---|---|---|---|
| 1,732,089 | 10/1929 | Honeyman, Jr. et al. | 26/94 |
| 1,806,208 | 5/1931 | MacKnight | 26/52 |
| 2,580,233 | 12/1951 | Laurie | 26/57 |
| 2,597,877 | 5/1952 | Le Clair | 26/74 |
| 2,729,874 | 1/1956 | McCreary | 26/61 |
| 3,050,816 | 8/1962 | McCreary | 26/61 |
| 3,150,432 | 9/1964 | McCreary | 26/57 |
| 3,179,976 | 4/1965 | Nash | 18/1 |
| 3,180,001 | 4/1965 | Nash | 26/61 |
| 3,258,866 | 7/1966 | Bates | 38/2 |
| 3,264,704 | 8/1966 | Prottengeier | 26/57 |
| 3,382,554 | 5/1968 | Harmon et al. | 26/57 |
| 3,430,310 | 3/1969 | Richbourg | 26/57 |
| 3,514,352 | 5/1970 | Judge, Jr. | 156/197 |
| 3,551,970 | 1/1971 | Cohn et al. | 26/59 |
| 3,590,450 | 7/1971 | Pernick | 26/51.3 |
| 3,604,079 | 9/1971 | Coates | 26/55 |
| 3,611,479 | 10/1971 | Wicksall | 26/89 |
| 3,636,598 | 1/1972 | Hannaway | 26/52 |
| 3,672,010 | 6/1972 | Fleissner | 26/60 |
| 3,881,229 | 5/1975 | Reid | 26/61 B |
| 3,916,492 | 9/1975 | Coates | 26/55 C |
| 3,932,919 | 1/1976 | Hutzenlaub | 26/57 |
| 3,935,979 | 2/1976 | Hickey | 226/19 |
| 3,936,915 | 2/1976 | Becker | 26/76 |
| 4,103,402 | 8/1978 | Frezza | 26/74 |
| 4,222,809 | 9/1980 | McLean et al. | 26/96 |
| 4,238,530 | 12/1980 | Hollaway et al. | 427/173 |
| 4,241,479 | 12/1980 | Dilo | 28/107 |
| 4,271,569 | 6/1981 | Grun et al. | 26/79 |
| 4,346,621 | 8/1982 | Griffin | 26/51.4 |
| 4,473,929 | 10/1984 | Green | 26/80 |
| 4,497,096 | 2/1985 | Richter | 26/74 |
| 4,541,353 | 9/1985 | Engle | 112/304 |
| 4,558,496 | 12/1985 | Cramer | 26/95 |
| 4,559,680 | 12/1985 | Gresens | 26/74 |
| 4,624,036 | 11/1986 | Diggle, Jr. et al. | 26/74 |
| 4,639,984 | 2/1987 | Langer | 26/89 |
| 4,646,402 | 3/1987 | Gierse et al. | 26/86 |
| 4,723,345 | 2/1988 | Pabst | 26/89 |
| 4,817,254 | 4/1989 | Poterala | 26/51.3 |
| 4,877,062 | 10/1989 | Hoefelmayr | 139/294 |
| 4,882,820 | 11/1989 | MacKinnon et al. | 26/93 |
| 4,890,365 | 1/1990 | Langer | 26/73 |
| 4,924,563 | 5/1990 | Catallo | 26/76 |

*Primary Examiner*—Clifford D. Crowder
*Assistant Examiner*—Amy B. Vanatta
*Attorney, Agent, or Firm*—Lerner, David, Littenberg, Krumholz & Mentlik

[57] ABSTRACT

A tentering system having a pair of spaced tenter rails defining a first end, a second end and a tentering path, and moveable material securement members carried by the tenter rails is disclosed. The tentering system may include first material guides at the first end of the tenter rails and second material guides at the second end of the tenter rails, and at least one drive motor for alternately and selectively driving the securement members in the first and second directions. In addition or in the alternative, a pair of direct drive motors is provided at the first end of the tenter rails, each of the direct drive motors including a clutch moveable between a drive position and a neutral position, and clutch actuating means to selectively and positively move the clutch from the neutral position to the drive position. In addition or in the alternative, first and second pairs of direct drive motors are provided at the first and second ends of the tenter rails, respectively. Still further, first and second tension adjusting motors are provided at the first and second ends of the tentering rails for selectively and independently adjusting the tentering width at the first and second ends and for adjusting the tension on material at the first and second ends. A method of tentering material on a finishing machine by alternately moving material in two opposite directions is also disclosed.

46 Claims, 5 Drawing Sheets

TENTERING APPARATUS AND METHOD

BACKGROUND OF THE INVENTION

The present invention relates generally to the tentering of material, and more particularly to the tentering of a material which alternately and selectively moves in opposite directions through a tentering field.

The tentering of materials relates to the securement of a material along its edges for drying and/or stretching such material. In many cases, tentering is used to stretch the width of material to a predetermined width, maintain the width of the material, allow the width of the material to shrink to a predetermined width, or to simply prevent side to side movement of the material. Tentering is often accomplished in conjunction with other finishing processes, such as heating; and thus the structure and arrangement of tentering devices must often accommodate the practice of such additional finishing processes. In some cases, materials can be over five-hundred (500) inches in width. Therefore, when such material is finished on a finishing machine including, for instance, ovens to heat the material and tenters to tenter the material, the tentering device must be arranged with respect to the lower and upper ovens so that the ovens can be positioned as close to the material on either side thereof.

The fabrics and materials which are tentered as part of an overall finishing process may include papermaker's clothing and textile materials such as woven and non-woven fabrics. Papermaker's clothing encompasses forming fabrics used by paper manufacturers to form the surface of paper products, wet felt-base fabrics, and dryer fabrics such as heavy woven fabrics. The present invention relates to the tentering of all such fabrics and materials, though it finds particular application with respect to the tentering of papermaker's clothing.

Conventional tentering devices include spaced tenter rails which define a tentering area therebetween. A tenter chain having tenter pins, grippers, clips or the like to secure an edge of material is carried by each tenter rail. The chains and pins, grippers, clips or the like are driven in one direction only by a single motor which translates the power necessary to drive the chains by mechanical means, such as gears, pulleys, etc. In some cases, the tenter rail includes at one end a guide section which is coextensive with the remaining section of the respective tenter rail, but is pivotally attached thereto. Each guide section typically carries a portion of the respective chain and pins, grippers, clips or the like in order to guide material into the tentering device so that the material can be moved through the tentering area toward the opposite end of the tentering rail. The material to be tentered is moved into the guide sections by material feeding and take-up rolls arranged at either end of the tentering device. In the case an endless web of material, the material is loaded on and between a pair of spaced rolls (often referred to as the head roll and tail roll) to form a loop which is moved by rotation of the rolls so that either the top flight or bottom pass of the material is moved through the tentering area.

Such conventional tentering devices are shown in U.S. Pat. Nos. 1,732,089 to Honeyman, Jr.; 3,264,704 to Prottengeier; 3,430,310 to Richbourg; 3,932,919 to Hutzenlaub; and 4,639,984 to Langer. Further, in at least one case, individual motor drives are provided for each tenter rail of a tentering system for driving the chains in a single direction, as shown in U.S. Pat. No. 2,580,233 to Laurie which provides a synchronizing shaft to mechanically connect the motors for weft straightening. In U.S. Pat. No. 4,497,096 to Richter, both chains are mechanically driven in a single direction by a single motor at the exit end, though two motors are provided at the entrance end to remove slack in the tentering chains which occurs at the exit end, thereby avoiding the chattering of the tenter chains.

During most finishing operations, the material must be held between the spaced rolls under extremely high tension to yield a product of high quality. By reason of such high tension, the medial portions of the rolls deflect towards one another as the loop of material is moved in the machine direction at the speeds required for finishing. Thus, the circumference of the loop of material at the machine's center line, i.e., near or at the center of the fabric width, is less than the circumference at the edges of the fabric. This is particularly true where wide lengths of fabric are being run through the tentering device. The result is that upon each revolution of the loop of material, the cross machine direction (CMD), i.e., those yarns running in the cross machine direction, near the machine's center line will advance ahead of the CMD yarns near the edges of the material. Thus, the material is bowed in the machine direction of movement. This is referred to as a leading bow of the warp yarn.

One attempt to reduce or eliminate this leading bow has been to advance the speed of the tentering device with respect to the speed of the driving roll on which the material is held. However, doing so only affects on those portions of the material which are adjacent the edges. Thus, for wide materials, there is no compensation for the lead bow in the center of the fabric. The result can be a "gull" like appearance of the CMD yarns where the medial portion of the fabric has a leading bow flanked by lagging bows between the leading bow and the edges of the fabric.

It is therefore desirable to provide a tentering apparatus and method which can eliminate or reduce the leading bow of the warp yarn without introducing a lagging bow or other infirmities which affect the integrity of the finished material. The present invention accomplishes these objectives, as well as several other objectives which will become apparent from the following.

Another shortcoming in connection with the finishing of materials by tentering in conjunction with, for instance, heating, is the period of time it takes to cool the material. After heating a material, it is often desirable to cool the material as rapidly as possible to improve the quality and characteristics of the finished material. In conventional finishing machines, the tentering device and ovens for heating are arranged closer to the head roll than to the tail roll, the tail roll being moveable depending upon the length of the material. Thus, there may be quite a distance between the ovens and the tail roll such that material moving from the head roll to the tail roll will cool only by exposure to the ambient temperature. Such cooling will occur at a relatively slow rate. The only options for more rapidly cooling material moving from the head roll to the tail roll using a conventional finishing machine would be to use external cooling apparatus. Of course, this can be expensive and difficult given the large size of the material and the structure and characteristics of finishing machines. The present invention addresses this shortcoming as well.

In addition, with respect to tentering devices arranged below the bottom pass of a continuous length of material looped on the head roll and tail roll, there is little clearance between the tenter pins, grippers or clips and the bottom pass of material. Therefore, care must be taken in loading and removing the continuous length of material on or from the rolls. Because of the large size of finishing machines and the structure of the mechanical drives used to drive the tenter chains, it is difficult to move the head roll and tail roll system and/or the tentering system with respect to one another. Heretofore, lower ovens arranged below the bottom pass of material have been elevated into position once the material is loaded, and lowered after completing the heating process. This allows the ambient air to cool all portions of the material, even the portions in the area of the oven. As stated above, such elevation of conventional tentering devices is not possible or at least difficult because of the large and intricate mechanical drives which translate the power needed to drive the tenter chains. The present invention also addresses this problem.

Further, some tentering systems provide one moveable tenter rail so that the width between the tenter rails can be adjusted for materials of different widths and, equally important, for adjusting the cross machine tension on material being moved through the tentering area. To adjust the width or tension, however, the entire moveable tenter rail must be moved such that the width at the first end is always equal to the width at the second end. While this may be acceptable for adjusting the system for materials of different widths, it may not be acceptable for adjusting the tension while material is moving through the tentering area. In the latter case, the tension on the material at the entrance of the tenter rails due to the sagging of the material, etc., may be less than the tension on the material at the exit. In any event, it may be desirable for other reasons to provide different tensions at different points on material as it is moved through the tentering area. The present invention also contemplates the introduction of different tensions on material moving through a tentering area, at least for a period of time.

Lastly, when the power to the tenter drive motors of conventional tentering devices fails, or the motor itself malfunctions, the tentering chains carrying the pins, grippers, clips or the like will stop moving because of the mechanical connections between the chains and/or motor which drive the chains. However, since the head roll is driven by a separate drive motor, the material may continue to rotate, whereby the material may be damaged along its ends where it is secured by the pins, grippers, clips or the like. The present invention also provides a safety feature so that the product being tentered is not destroyed should the motor malfunction.

SUMMARY OF THE INVENTION

The present invention relates to a tentering system having a pair of spaced tenter rails which define a first end, a second end and a tentering path, moveable securement means carried by the tenter rails, first material guiding means at the first end of the tenter rails for guiding material into the tentering path from the first end so that the material can be moved in a first direction from the first end to the second end, second material guiding means at the second end of the tentering rails for guiding material into the tentering path from the second end so that material can be moved in a second direction from the second end, and drive means for alternately and selectively driving the securement means in the first direction and the second direction, whereby the first material guiding means is operative to guide material into the tentering path at least when the drive means is driving the securement means in the first direction, and the second material guiding means is operative to guide material into the tentering path at least when the drive means is driving the securement means in the second direction. The material guiding means are adapted to vary the width at the respective first and second ends so as to follow the material edges, and may comprise pivotally moveable material guiding sections.

The present invention also relates to a tentering system having a pair of spaced tenter rails to define a first end, a second end and a tentering path, a pair of moveable securement means carried by the tenter rails, a first pair of direct drive motors at the first end of the tenter rails, such that there is a direct drive motor associated with each of the pair of securement means for driving the respective securement means in a second direction from the second end to the first end, and a second pair of direct drive motors at the second end of the tenter rails such that there is a direct drive motor associated with each of the pair of securement means for driving the respective securement means in a first direction from the first end to the second end, whereby the first pair of direct drive motors is adapted to remain idle while the second pair of direct drive motors are operated to drive the securement means in the first direction, and the second pair of direct drive motors is adapted to remain idle while the first pair of direct drive motors are operative to drive the securement means in the second direction.

In addition, the present invention relates to a tentering system having a pair of spaced tenter rails defining a first end, a second end and a tentering path, moveable securement means carried by the tenter rails, and a first pair of direct drive motors at the first end of the tenter rails such that there is a direct drive motor associated with each of the pair of securement means for driving such securement means, each direct drive motor including a clutch moveable between a drive position whereby the respective direct drive motor drives the respective securement means and a neutral position whereby the securement means are moveable independently of the direct drive motors, the clutch normally being in the neutral position, and clutch actuating means for selectively and positively moving the clutch from the neutral position into the drive position. The clutch actuating means are constructed and arranged to release the clutch from the drive position to the neutral position when there is a loss of power or the direct drive motor.

Further, the present invention relates to a tentering system having a pair of spaced tenter rails to define a first end, a second end and a tentering path, the tentering path having a tentering width between the tenter rails, moveable securement means carried by the tenter rails, one of said tenter rails being moveable relative to the other tenter rail to vary the tentering width and maintain the desired cross machine tension on material moving through the tentering area, first tension adjusting means associated with the moveable tenter rail at the first end for selectively adjusting the tension on material secured between the tenter rails at the first end, second tension adjusting means associated with the moveable tenter rail at the second end for selectively adjusting the tension on material secured between the tenter rails at the second end, the first and second tension adjusting means being operative independent of one another, and drive means associated with the securement means for driving the securement means.

Still further, the present invention relates to a method of tentering material on a finishing machine which includes a pair of spaced tenter rails defining a first end, a second end and a tentering path, securement means on each of the tenter rails, a first material roll arranged adjacent the first end and a second material roll arranged adjacent the second end, the method including the steps of loading an endless web of material on and between the first and second rolls, arranging the material such that a portion thereof is engaged and held by the securement means in the tentering path, moving the material such that the engaged portion of material moves in a first direction from the first end to the second end while simultaneously driving the securement means in the first direction, stopping the movement of the material, and moving the material such that the engaged portion of material moves in a second direction from the second end to the first end and simultaneously driving the securement means in the second direction.

Accordingly, it is an object of the present invention to provide a tentering device having material securement means which, together with material secured thereby, can be moved in opposite machine directions, whereby a material which developed (or may develop) a leading bow from being run in a first machine direction can be run in the opposite second machine direction to reduce or eliminate such leading bow, and whereby a heated material can be moved in the opposite machine direction to use, for instance, a steel head roll as a heat sink.

It is another object of the present invention to provide a tentering device having four individual direct drive motors for driving the chain and associated pins, grippers, clips or the like, one motor at each end of each tentering rail, such that the set of motors at one end of the tentering device remain idle while the set of motors at the other end of the tentering device drive the respective chains, and vise-versa.

It is a further object of the present invention to provide a tentering device having guide means at either end thereof for guiding material into the tentering area defined by the opposing tentering rails.

It is still a further object of the present invention to provide direct drive motors for driving each tentering chain, each direct drive motor having a clutch which must be positively engaged to drive the tentering chains, and which is adapted to release the respective chains to be freely moveable upon the loss of power to the respective motor or the failure of the respective motor.

It is another object of the present invention to provide a tentering device which is adapted to be lowered and raised with respect to the rolls, and thus the material, of a finishing machine.

BRIEF DESCRIPTION OF THE DRAWINGS

The foregoing and other objects, advantages, characteristics and features of the present invention will become apparent, as will a better understanding of the concepts underlying the present invention, with reference to the description which follows and refers to the accompanying drawings in which.

DETAILED DESCRIPTION OF THE INVENTION

Figure 1:
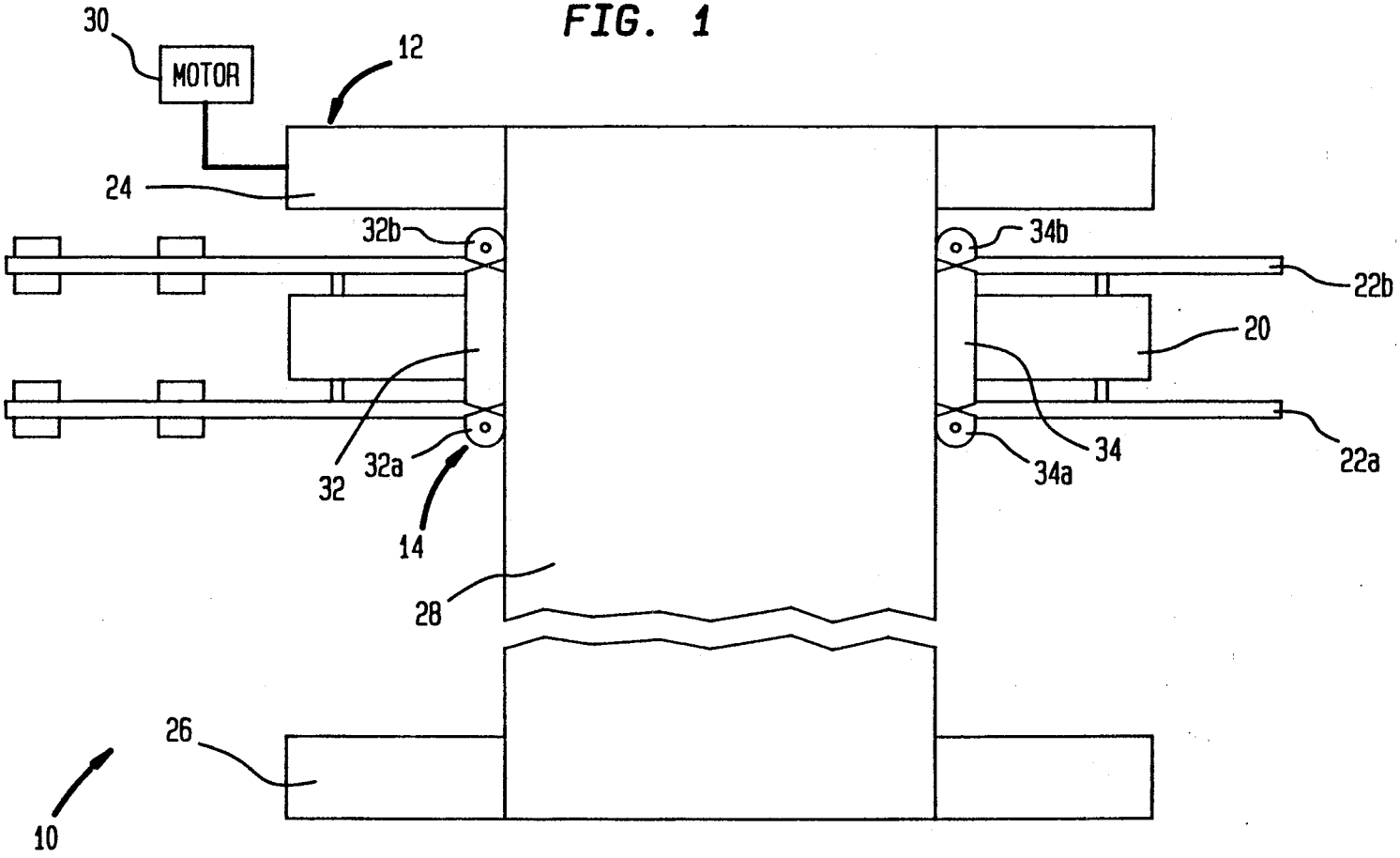
FIG. 1 is a schematical top plan representation of a finishing machine which includes a tentering system in accordance with the present invention.
Figure 2:
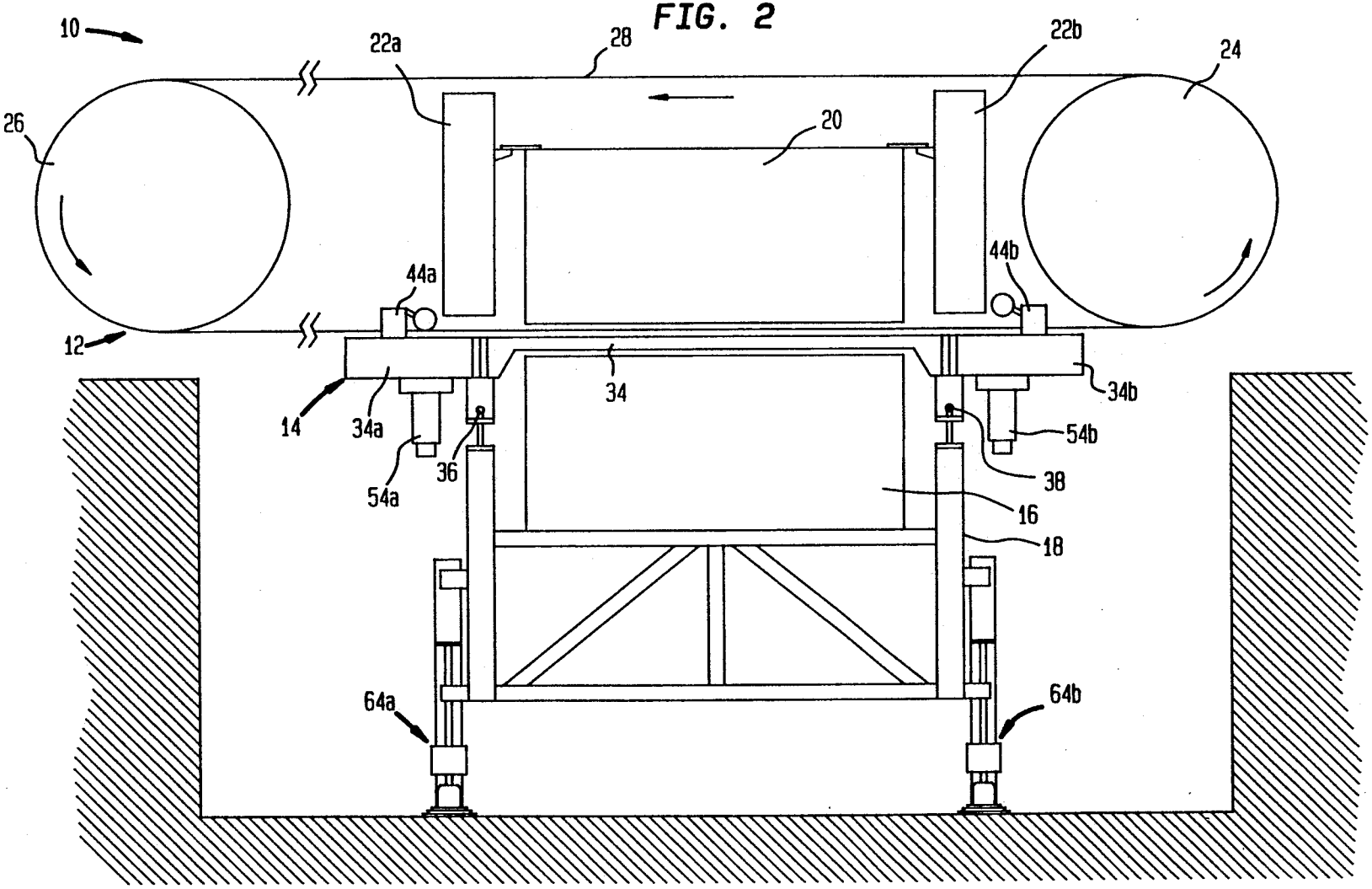
FIG. 2 is a right side elevational view of a finishing machine which includes a tentering system in accordance with the present invention, showing the tentering system and lower oven positioned substantially below ground level.

Referring to the figures, FIGS. 1 and 2 illustrate the primary elements of a finishing machine for the treatment of a continuous length of material, such finishing machine being generally designated as 10. The finishing machine 10 includes a material moving system generally designated as 12 and a tentering system generally designated as 14. The finishing machine 10 is particularly adapted to subject a length of material to a heating process simultaneously with the tentering process, though it is noted that the tentering system 14 can be used in connection with finishing machines of any type. For instance, the tentering system 14 can be used to facilitate the tentering of endless webs or finite lengths of a textile material. For the purposes of heating a material, a lower oven 16 is carried by frame support 18 and an upper oven 20 is carried by cantilever beams **22*a* & 22*b***.

Material moving system 12 includes a head roll 24 and a tail roll 26 which are arranged substantially perpendicular to the rails of the tentering system 14 in order to hold and move an endless web or loop of material 28 such that the bottom pass of material can pass between the ovens 16 & 20 and through the tentering area defined by the rails of the tentering system 14. In this regard, the head roll 24 is rotated by a motor 30, shown as a black box in FIG. 1. It is noted that upper oven 20 is supported by cantilever beams **22*a* and 22*b* so the material 28 can be loaded onto and between the rolls 24 & 26 from the right side of the finishing machine 10**.

Figure 3:
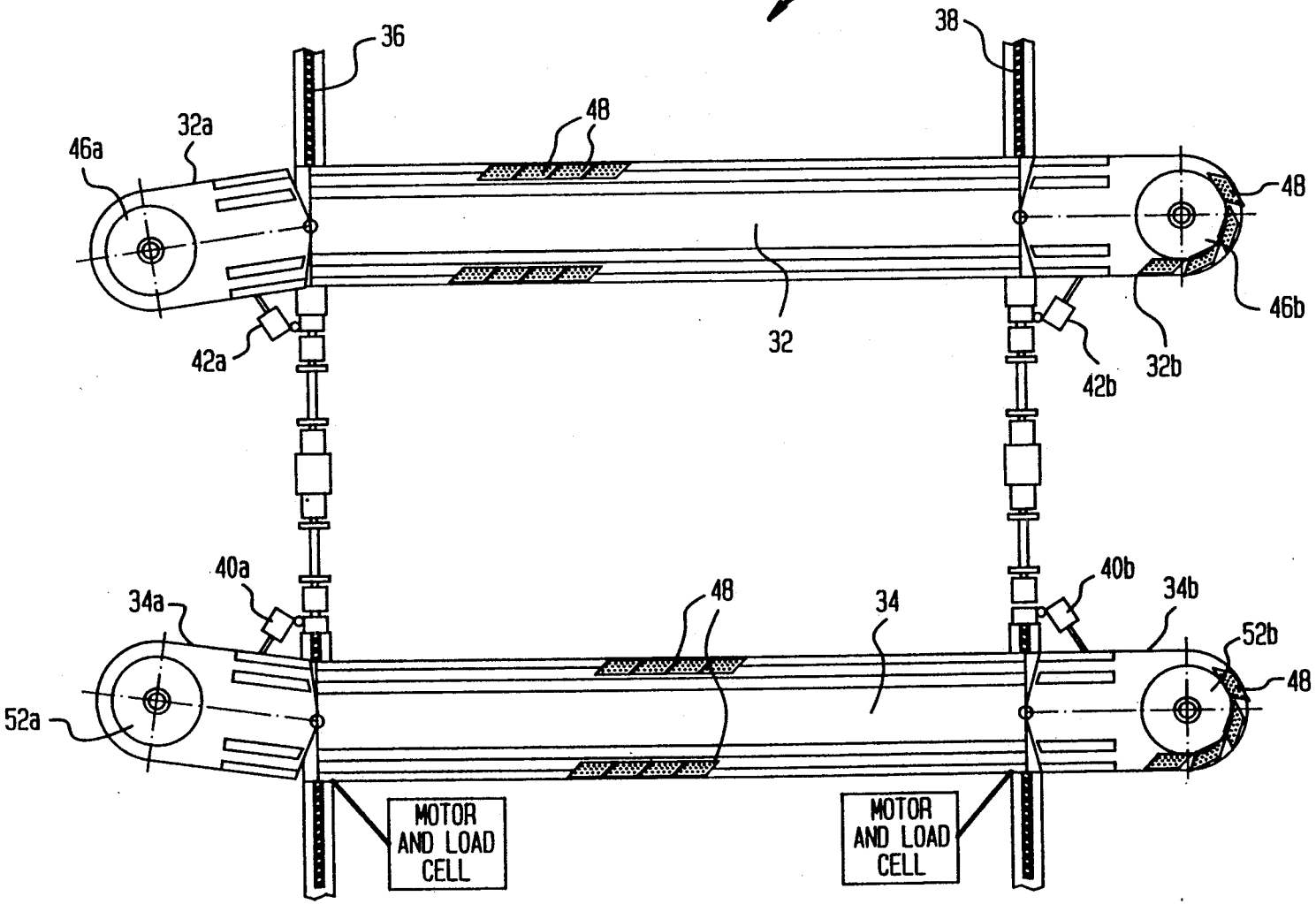
FIG. 3 is a top view of the tentering system shown in FIG. 2.
Figure 4:
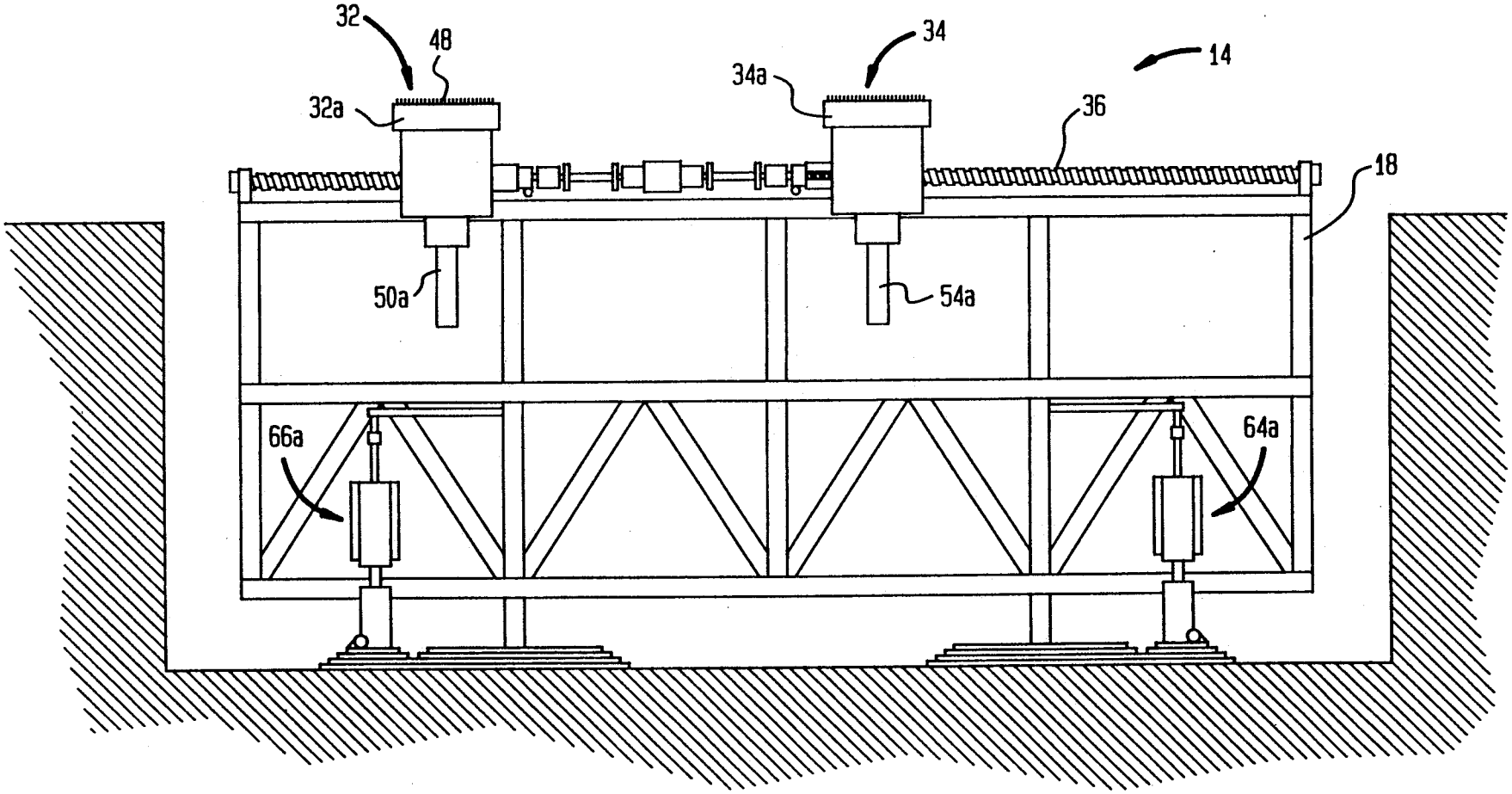
FIG. 4 is a front view of the tentering system shown in FIG. 2.

The tentering system 14, shown most clearly in FIGS. 2, 3 and 4, includes tenter rails 32 and 34 which are mounted on frame support 18. The rails 32 and 34 are carried by cross screws 36 and 38 which enable the rails 32 and 34 to be moved toward and away from one another. Thus, the rails 32 and 34 define an adjustable tentering area therebetween.

The tenter rails 32 and 34 each include pivotally moveable guide sections at each end, such guide sections being provided to vary the width between the tenter rails 32 and 34, or to selectively and independently vary, at either end of the tentering system 14, the tension on material being moved through the tentering area. More specifically, tenter rail 32 includes a pivotal guide section **32*a* adjacent the tail roll 26 and pivotal guide section 32*b* adjacent the head roll 24. Similarly, tenter rail 24 includes guide section 34*a* adjacent the tail roll 26 and guide section 34*b* adjacent the head roll 24. In FIG. 3, the guide sections 32*a* and 34*a* are shown in a slightly inward pivoted position with respect to the remaining portions of the respective tenter rails 32 and 34. In the inwardly pivoted position, the respective guide sections can follow the incoming material edges which can be more narrow than material which is already pinned or clipped. This occurs because there is less tension at the entrance and the material often sags prior to being fully received in the pinning area. Although only guide sections 32***a* and 34*a* are shown in pivoted positions, it is preferable, though not required in accordance with the broad concepts underlying the present invention, that all guide sections be operative to follow the edges of the material 28 at either end of the system, regardless of the direction in which the material is being moved. In this manner, the system is always adapted to change the direction of movement of the material. It is further noted, however, that the guide sections can, depending on the particular application, be pivoted outwardly as well.

The pivotal movement of each guide section is actuated by independently operable pivot drives, each of which comprises a piston and cylinder arrangement fixed between the frame support 18 and the respective guide section. Thus, pivot drives 40*a* and 42*a* are arranged to pivotally move guide sections 32*a* and 34*a*, respectively; and pivot drives 40*b* and 42*b* are arranged to drive guide sections 32*b* and 34*b*, respectively.

The tenter rails 32 and 34 further include tenter chains carrying pin plates 48 which have mounted thereon a plurality of pins for securing the marginal edges of the material 28 as it is moved through the tentering area. As can be seen in FIG. 3, the chains, and thus the pin plates 48, extend around the periphery of each tenter rail, including around the respective guide sections of each tenter rail. Although not shown, pin plates 48 are provided around the entire periphery of each tenter rail.

To facilitate the pinning of the material 28 to the pins on the pin plates 48, pinning devices are provided at each end of each tenter rail. Pinning devices 44*a* and 44*b* are shown in FIG. 2 for tenter rail 34. These pinning devices are conventional and, when, for instance, pneumatically actuated, they force the fabric on the bottom pass onto the pins of the pin plates 48 so that the marginal edges of the material 28 are secured throughout the tentering area. Though the pinning devices for the tenter rail 32 are not shown, they operate in the same manner. Of course, only the set of pinning devices at the receiving end of the tenter rails, that is, the end which receives the fabric and moves toward the other end, will be operative to pin the material 28 to the pins of the pin plates 48; the other set of pinning devices being positioned in a normally open position away from the material as it exits the tenter rails. For example, pinning device 44*a* (and its counterpart on rail 32) will be pneumatically actuated when the bottom pass of the material is moving from the tail roll 26 to the head roll 24 (counter clockwise rotation of the material 28); while the pinning device 44*b* (and its counterpart on rail 32) remain in their normally open position, as shown in FIG. 2.

In addition, the tenter rails 32 and 34 include tenter drive motors at each end to facilitate the direct driving of the tenter chains and the pin plates 48. More specifically, the tenter drive motors are associated with the sprockets at the respective ends of the tenter rails, which in turn, drive the chains. Thus, tenter rail 34 includes tenter drive motor 54*a* for directly driving sprocket 52*a* and tenter drive motor 54*b* for directly driving sprocket 52*b*. Likewise, tenter rail 32 includes tenter drive motor 50*a* for directly driving sprocket 46*a* and tenter drive motor 50*b* for directly driving sprocket 46*b*. It is noted that the guide sections carry the sprockets and respective tenter drive motors even when pivoted by the respective pivot drives.

Figure 5:
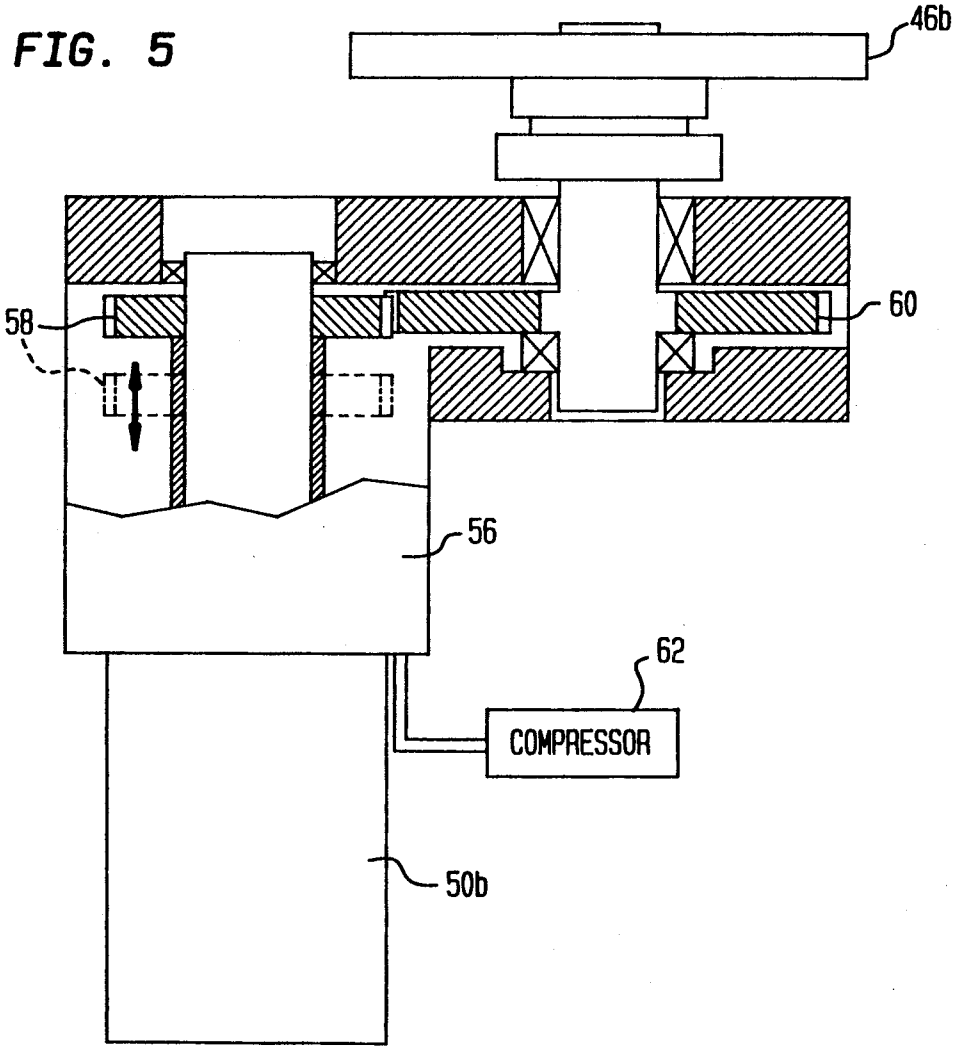
FIG. 5 is a partially broken away side view of a tenter chain motor and motor housing, as provided at each end of each tenter rail.

FIG. 5 specifically shows the manner in which each individual tenter drive motor drives its respective sprocket. Thus, tenter drive motor 50*b* is shown in assembled position on a clutch and speed reduction housing 56. Within the housing 56 is the clutch 58 and gearing (not shown) for reducing the speed of the motor 50*b*. The clutch 58 is shown in the drive position (or engaged position), that is, in positive engagement with gear 60 which, in turn, translates the power from the motor 50*b* to the sprocket 46*b*. The neutral position (or disengaged position) of clutch 58 is shown in phantom, out of engagement with the gear 60. The clutch 58 is normally held in the neutral position by springs (not shown), against which actuation means must work to shift the clutch into the drive position. When the clutch 58 is in the neutral position, the sprocket 46*b*, and thus the tenter chains associated therewith, are freely moveable. The actuation of the clutch 58 is preferably accomplished pneumatically by means of a compressor 62, but can be accomplished by any other suitable means, such as hydraulically or electronically, for positively engaging the clutch 58 with the gear 60.

A solenoid valve is provided to facilitate the pneumatic and positive movement of the clutch 58 into the drive position when the respective tenter drive motor is energized to drive the securement means. Also provided is a fault circuit having a fault contact which, in its positively closed position, permits the clutch 58 to be in the drive position. The fault circuit is associated not only with the respective tenter drive motor, but also the other tenter drive motors, the head roll motor, or any other motor or device, such that the operation of such motors or devices can be monitored by computer or otherwise. In particular, the fault circuit is adapted to detect any malfunction, including loss of power, of such motors and devices so that the fault contact can be automatically opened to thereby cause the solenoid valve to open, whereupon the clutch 58 would release to the neutral position.

Thus, as indicated above, the tenter chains and pin plates 48 can move independently of the respective tenter drive motor when the clutch is in the neutral position. Therefore, should a given tenter drive motor (or any other motor or device) malfunction or power should be lost, the clutch will automatically release from its positive engagement so that material moving under the influence of the head roll drive will not be damaged at its pinned edges. Rather, the head roll drive or the momentum after such drive has been terminated will continue to move the tenter chains. This is contrary to what would occur with a mechanical drive system. With a mechanical drive system, the gearing and connections required to transmit the power from a single motor prevent the chains from being freely moveable. Such mechanical drives cannot, therefore, use a positive engagement feature as herein.

It is particularly noted that the set of tenter drive motors adjacent the head roll, i.e., motors 50*b* and 54*b*, are provided to drive the bottom pass of material 28 from the tail roll to the head roll. As those skilled in the art will readily appreciate, it is preferable to provide the drive motors at the exit end of the tenter rails. In this manner, the motor is used more efficiently, and the chains will not kink during movement. Thus, in FIG. 2, tenter drive motors 50*a* (not shown) and 54*a* remain idle (clutch in neutral mode), while tenter drive motors and 50*b* (not shown) and 54*b* drive the loop of material 28 in a counterclockwise direction so that the bottom pass of such material moves from the tail roll to the head roll. It is noted once again that pinning device 44*b* is in its normally open position while pinning device 44*a* is in its pinning position to pin the material 28 to the pins on the plates 48 as the material 28 enters the tenter rails. Of course, when reversing the direction of the bottom pass of material 28, i.e., rotating the loop of material 28 in the clockwise direction as shown in FIG. 2, the tenter drive motors 50*b* and 54*b* would be idle while the tenter drive motors 50*a* and 54*a* would be operative to drive the chain and pin plates 48 from the head roll to the tail roll. Likewise, the pinning device 44*b* would be moved into the pinning position while the pinning device 44*a* would be released to its normally open position.

With respect to the guide sections, the guide sections on the selected entrance end of the tenter rails would be operable to guide the material 28 into the tentering area, that is, follow the material edges. The set of guide sections at the selected exit end of the tenter rails are preferably energized as well to follow the material edges as the material exits the rails. In the alternative, the exit guide sections can remain coextensive with the central portions of the rails. However, the exit guide sections will not be arranged for reversing the movement of the material, and must be energized prior to reversing the material movement More specifically, when the tenter drive motors 50*b* and 54*b* are driving the chains from the tail roll to the head roll, as in FIG. 2, the guide sections 32*a* and 34*a*, must be operable to follow the material edges into the tentering area, while the guide sections 32*b* and 34*b* are preferably operable. It is noted that in FIG. 3, the guide sections 32*a* and 34*a* are pivoted slightly inward to accommodate a material which is more narrow at the entrance due to sagging. The guide sections can, however, be pivoted outwardly or inwardly depending on the material edge location.

The frame support 18 further includes four lifting jacks to raise and lower the tentering system 14 and the lower oven 16. Such lifting jacks, generally designated as 64*a*, 64*b* and 66*a* (66*b* not being shown), can be of any conventional type capable of elevating the weight of the frame support 18, tentering system 14 and lower oven 16. As noted above, such lifting jacks enable the operator to lower the tentering system 14 as well as the lower oven 16 so that the material 28 can be removed from the head roll 24 and the tail roll 26 without damaging the same on the pins of the pin plates 48. It was heretofore difficult to employ such lifting jacks to lift the tentering system 14 as well as the lower oven 16 since the tentering system 14 was extremely heavy and not compact as it included mechanical means for translating power to the tenter chains.

Referring to FIG. 3, it can be seen that the tenter rail 34 is provided with a width adjusting motor and load cell at each end thereof. Each motor operates independently of the other to adjust the width between the tenter rails by moving the respective end of the tenter rail 34 on the respective cross screw (cross screw 36 or cross screw 38). The load cell for each motor is provided to monitor the tension of the material at the respective ends of the rails as such material is moving through the tentering area. Thus, the motor and load cell on cross screw 38 can move the right end of tenter rail 34 in either cross machine direction to vary the tentering width to accommodate material of any width, or to vary the tension on material already in the tentering area to a predetermined or desired tension. This can be accomplished independently of the tension at the left side of the tenter rails where the width and tension can be varied by the motor and load cell on cross screw 36. This is a particularly important feature in the context of the alternately moving the material in opposite machine directions since either end of the tenter rails must serve as entry and delivery at one time or another.

The structure of the tentering system 14, as set forth above, can be used in conjunction with a method of compensating for the leading bow of the warp yarn introduced by the deflection of the head roll and tail roll.

Thus, the method in accordance with this aspect of the present invention contemplates the provision of a finishing machine having a tentering system similar to tentering system 14 shown in the figures. As noted earlier, material moving means other than the material rotating system 12 described and illustrated herein may be used in accordance with the present invention. The material must, however, be arranged to move through the tentering area defined by the tentering rails 32 and 34. In the illustrated embodiment, the endless web of material 28 would be loaded on and between the head roll 24 and the tail roll 26 so that the bottom pass thereof was arranged to move through the tentering area. Of course, it is possible to arrange the material rotating system 12 and the tentering system 14 so that the top pass of material 28 moves through the tentering area. However, it is preferable to run the material on the bottom pass. Among the advantages of doing so are the capability of attaining higher tension in the material and the ability to use the exit roll to strip the material from the pins by arranging the exit roll to be above the pins.

Referring to FIG. 2, the head roll 24 is rotated in the counterclockwise direction to move the material 28 in the counterclockwise direction, that is, so that the bottom pass moves from the tail roll to the head roll. The pinning device 44*a* is actuated to its pinning position so as to force the fabric 28 onto the pins on the pin plates 48. Simultaneously, the tenter drive motors 50*b* and 54*b* are operated to move the interior pin plates 48 from the tail roll 26 to the head roll 24. At least the pivot drives 40*a* and 42*a* are actuated to pivotally adjust the guide sections 32*a* and 34*a* to follow the edges of the material 28. This may be in the outward or inward direction, depending upon the material edge location. Of course, it is desirable to also actuate the guide sections 32*b* and 34*b* to also follow the material edges.

The material 28 is run in the machine direction from the tail roll to the head roll until completing the tentering and/or other processing of the material, or until at least a predetermined portion of the tentering and/or other processing has been accomplished. The clutches in the tenter drive motors 50*b* and 54*b* are then released so that the pin plates 48 are freely moveable about the respective rails (the motors 50*b* and 54*b* can then be shut down), and the head roll drive motor 30 can be shut down. Once the material 28 is no longer moving in a counterclockwise direction, the head roll motor 30 and tenter drive motors 50*a* and 54*a* are actuated so that the interior pin plates 48 move from the head roll to the tail roll and the material 28 is moving in a clockwise direction. Thus, the bottom pass moves from the head roll 24 to the tail roll 26. The pinning device 44*b* is also actuated to facilitate the continuous pinning of the incoming material onto the pins of the pin plates 48.

The leading bow of the warp yarn introduced while running the material 28 in the counterclockwise direction will be significantly reduced or eliminated by running the material in the clockwise direction.

As noted above, it is often desirable to rapidly cool a material which is heated during a tentering process. The above-described method of running the material 28 in two opposite machine directions is also useful to facilitate the rapid cooling of the material 28 which has undergone a heating process in conjunction with the tentering process. This can be accomplished by using the roll at the entrance end of the tentering system 14 as a heat sink. Typically, this would be desirable when the head roll is at the entrance end of the tentering system 14, that is, when the material is being run initially in the clockwise direction so that the bottom pass of the material 28 is moving from the head roll to the tail roll. It is noted that this is the opposite of that which is shown in FIG. 2. The head roll 24 is thus closer to the ovens than the tail roll 26 which may, depending upon the length of the material 28, be at quite a distance from the ovens. Thus, when a portion of the material 28 is heated between the ovens 16 and 20, the tentering system and the drive motor 30 can be reversed so that the material 28 is moving in the counterclockwise direction. The heated portion of the material is then wrapped around the head roll 24, typically made of steel, so that the head roll causes the rapid cooling of the material 28 as the heat from the material 28 is conducted to the head roll 24. It is noted that the material 28 can be moved slowly around the head roll 24 to facilitate such rapid cooling, or can be stopped on the head roll 24.

While the foregoing description and figures illustrate a preferred embodiment of the finishing machine and tentering system in accordance with the present invention, it should be appreciated that certain modifications can be made, and are indeed encouraged to be made, in the structure, arrangement and use of the disclosed embodiment without departing from the spirit and scope of the present invention which is intended to be captured by the claims set forth below.

I claim:

1. A tentering system comprising:

a. a pair of spaced tenter rails defining a first end, a second end and a tentering path between said tenter rails;

b. movable securement means carried by said tenter rails for holding material while such material is moved through said tentering path, such material having marginal edges and said securement means being adapted to hold such material substantially at such marginal edges;

c. first material guiding means at said first end of said tenter rails for guiding material into said tentering path from said first end so that such material can be moved in said tentering path in a first direction from said first end to said second end;

d. second material guiding means at said second end of said tenter rails for guiding material into said tentering path from said second end so that such material can be moved in said tentering path in a second direction from said second end to said first end; and e. drive means for driving said movable securement means of each said tenter rail, said drive means being constructed and arranged to alternately and selectively drive said securement means in said first and second directions, said first material guiding means being operative to guide material into said tentering paths at least when said drive means is driving said securement means in said first direction, and said second material guiding means being operative to guide material into said tentering path at least when said drive means is driving said securement means in said second direction.

2. The tentering system in claim 1, wherein said tenter rails define a predetermined tentering width in said tentering path, and said first and second material guiding means are adapted to vary the width at the respective said first and second ends with respect to said predetermined tentering width, and wherein said first and second material guiding means are both operative to follow such marginal edges at all times regardless of the direction of movement of the material.

3. The tentering system in claim 1, wherein said tenter rails define a predetermined tentering width in said tentering path, and wherein said first material guiding means comprises a first material guiding section substantially coextensive with at least one of said tenter rails at said first end and said second material guiding means comprises a second material guiding section substantially coextensive with at least one of said tenter rails at said second end, said first and second material guiding sections being moveable to adjust the width at the respective said first and second ends without adjusting the predetermined tentering width.

4. The tentering system in claim 3, wherein said first material guiding section is pivotally connected to at least one of said tenter rails at said first end and is adapted to be pivotally moveable to guide material into said tentering path for movement in said first direction, and said second material guiding section is pivotally connected to at least one of said tenter rails at said second end and is adapted to be pivotally moveable with respect to one of said tenter rails to guide material into said tentering path for movement in said second direction.

5. The tentering system in claim 3, wherein said drive means includes a first pair of direct drive motors arranged on said tenter rails at said first end such that individual direct drive motors of said first pair are associated with said securement means on said tenter rails to drive said securement means, and a second pair of direct drive motors arranged on said tenter rails at said second end such that the individual direct drive motors of said second pair are associated with said securement means on said tenter rails to drive said securement means.

6. The tentering system in claim 5, wherein said first pair of direct drive motors are constructed and arranged to drive said securement means in said first direction, and said second pair of direct drive motors are constructed and arranged to drive said securement means in said second direction.

7. The tentering system in claim 6, wherein said individual direct drive motors of said first and second pairs of direct drive motors are constructed and arranged to be operated independently of one another.

8. The tentering system in claim 7, wherein each said individual direct drive motor includes, (i) a clutch moveable between a drive position whereby the respective said direct drive motor drives the respective said securement means and a neutral position whereby said securement means are moveable independently of said direct drive motors, said clutch normally being in said neutral position, and (ii) clutch actuating means for selectively and positively moving said clutch from said neutral position into said drive position, said clutch actuating means being constructed and arranged to release said clutch from said drive position to said neutral position when a loss of power or a malfunction is detected.

9. The tentering system in claim 8, wherein each said clutch actuating means is pneumatic.

10. The tentering system in claim 9, wherein one of said tenter rails is constructed and arranged to be moveable with respect to the other said tenter rail so as to vary said tentering width.

11. The tentering system in claim 10, including first width adjusting means associated with said moveable tenter rail at said first end and a second tenter width adjusting means associated with said moveable tenter rail at said second end, said first and second tenter width adjusting means being adapted to move the moveable tenter rail at the respective ends to thereby adjust the width between the tenter rails at the respective ends, said first and second tenter width adjusting means being operable independently of one another.

12. The tentering system in claim 11, wherein said first and second tenter width adjusting means include first and second load cells, respectively, for monitoring the tension on material in the tentering area at said first and second ends, respectively.

13. The tentering system in claim 12, wherein said securement means comprise pins.

14. The tentering system in claim 13, including material moving means for facilitating the movement of material through said tentering path.

15. The tentering system in claim 14, wherein said material moving means includes a head roll arranged transverse to said tenter rails at said first end and a tail roll arranged transverse to said tenter rails at said second end, said head roll and said tail roll being parallel to one another and being arranged to rotate an endless web of material between said tenter rails such that the material is guided into said tentering path by one of said material guiding sections and secured at its marginal edges by said pins during movement through said tentering path.

16. The tentering system in claim 15, wherein said head roll and said tail roll are arranged such that an endless web of material can be loaded on and between said rolls to form a loop of material having upper and lower bands of material between said rolls.

17. The tentering system in claim 16, wherein said head roll and said tail roll are arranged such that the lower band of material moves through said tentering path between said tenter rails.

18. The tentering system in claim 17, including elevation means for raising and lowering at least said pair of tenter rails, said securement means and said material guiding means with respect to said head roll and said tail roll so as to facilitate the loading and removal of an endless web of material onto and from said rolls.

19. The tentering system in claim 1, wherein said first material guiding means comprises a first set of material guiding sections at said first end of said tenter rails and said second material guiding means comprises a second set of material guiding sections at said second end of said tenter rails, said first and second guiding sections being moveable to adjust the width at the respective said first and second ends.

20. The tentering system in claim 1, wherein said securement means and said drive means are so constructed and arranged with respect to one another that said securement means are freely moveable when not engaged to be driven by said drive means.

21. The tentering system in claim 20, wherein said drive means include at least a first pair of direct drive motors at said first end, each said direct drive motor including, (i) a clutch moveable between a drive position whereby the respective said direct drive motor drives the respective said securement means and a neutral position whereby said securement means are moveable independently of said direct drive motors, said clutch normally being in said neutral position, and (ii) clutch actuating means for selectively and positively moving said clutch from said neutral position into said drive position, said clutch actuating means being constructed and arranged to release said clutch from said drive position to said neutral position when a loss of power or a malfunction is detected.

22. The tentering system in claim 1, wherein said securement means comprise pins.

23. The tentering system in claim 22, wherein said securement means further comprise a plurality of pin plates, each of which carries a plurality of pins.

24. A tentering system comprising:

a. a pair of spaced tenter rails defining a first end, a second end and a tentering path between said tenter rails;

b. a pair of moveable securement means carried by said tenter rails for holding material while such material is moved through said tentering path, such material having marginal edges and said securement means being adapted to hold such material substantially at such marginal edges;

c. a first pair of direct drive motors at said first end of said tenter rails, there being a direct drive motor associated with each said securement means of the respective tenter rails for driving the respective said securement means in a second direction from said second end to said first end; and d. a second pair of direct drive motors at said second end of said tenter rails, there being a direct drive motor associated with each said securement means of the respective said tenter rails for driving the respective said securement means in a first direction from said first end to said second end, said first pair of direct drive motors being adapted to remain idle when said second pair of direct drive motors are operative to drive said securement means in said first direction, said second pair of direct drive motors being adapted to remain idle when said first pair of direct drive motors are operative to drive said securement means in said second direction.

25. The tentering system in claim 24, further including a sprocket at each end of each tenter rail and a pair of endless tenter chains carried by said tenter rails such that said chains are operatively associated with said sprockets of the respective said tenter rails, each said direct drive motor being associated with a sprocket to drive said tenter chains.

26. The tentering system in claim 25, wherein each said direct drive motor includes, (i) a clutch moveable between a drive position whereby the respective said direct drive motor drives the respective said securement means and a neutral position whereby said securement means are moveable independently of said direct drive motors, said clutch normally being in said neutral position, and (ii) clutch actuating means for selectively and positively moving said clutch from said neutral position into said drive position, said clutch actuating means being constructed and arranged to release said clutch from said drive position to said neutral position when a loss of power or a malfunction is detected.

27. The tentering system in claim 26, wherein said direct drive motors of said first and second pairs of direct drive motors are constructed and arranged to be operated independently of one another.

28. The tentering system in claim 27, wherein said clutch actuating means is pneumatic.

29. The tentering system in claim 28, including material moving means for facilitating the movement of material through said tentering path.

30. The tentering system in claim 29, wherein said material moving means includes a head roll arranged transverse to said tenter rails at said first end and a tail roll arranged transverse to said tenter rails at said second end, said head roll and said tail roll being parallel to one another and being arranged to rotate an endless web of material between said tenter rails such that the material is moved through said tentering path while being secured at its marginal edges by said securement means.

31. The tentering system in claim 30, wherein said head roll and said tail roll are arranged such that an endless web of material can be loaded on and between said rolls to form a loop of material having upper and lower substantially horizontal bands of material between said rolls.

32. The tentering system in claim 31, wherein said head roll and said tail roll are arranged such that the lower band of material moves through said tentering path.

33. The tentering system in claim 32, including elevation means for raising and lowering at least said pair of tenter rails with respect to said head roll and said tail roll so as to facilitate the loading and removal of an endless web of material onto and from said rolls.

34. A tentering system comprising:

a. a pair of spaced tenter rails defining a first end, a second end and a tentering path between said tenter rails;

b. a pair of moveable securement means carried by said tenter rails for holding material while such material is moved through said tentering path, such material having marginal edges and said securement means being adapted to hold such material substantially at such marginal edges; and c. a first pair of direct drive motors at said first end of said tenter rails, there being a direct drive motor associated with each said securement means for driving the same, each said direct drive motor including, (i) a clutch moveable between a drive position whereby the respective said direct drive motor drives the respective said securement means and a neutral position whereby said securement means are moveable independently of said direct drive motors, said clutch normally being in said neutral position, and (ii) clutch actuating means for selectively and positively moving said clutch from said neutral position into said drive position, said clutch actuating means being constructed and arranged to release said clutch from said drive position to said neutral position when there is a loss of power.

35. The tentering system in claim 34, wherein said clutch actuating means includes means for pneumatically forcing said clutch into said drive position.

36. The tentering system in claim 35, wherein said securement means include pins for securing such marginal edges of a length of material.

37. The tentering system in claim 36, including material moving means for facilitating the movement of material through said tentering path, said material moving means including a head roll arranged transverse to said tenter rails at said first end and a tail roll arranged transverse to said tenter rails at said second end, said head roll and said tail roll being parallel to one another and being arranged to rotate a continuous length of material such that the material moves through said tentering path.

38. The tentering system in claim 37, wherein said head roll and said tail roll are arranged such that an endless web of material can be loaded on and between said rolls to form a loop of material having upper and lower substantially horizontal bands of material between said rolls, the lower band of material moving through said tentering path.

39. The tentering system in claim 38, including elevation means for raising and lowering at least said pair of tenter rails with respect to said head roll and said tail roll so as to facilitate the loading and removal of an endless web of material onto and from said rolls.

40. The tentering system in claim 34, including material moving means for facilitating the movement of material through said tentering path, said material moving means being constructed and arranged to hold an endless web of material in the form of a loop having upper and lower substantially horizontal bands of material, and either the lower or upper band of material moves through said tentering path.

41. A method of tentering material on a finishing machine which includes a pair of tenter rails defining a first end, a second end and a tentering path, securement means on each of the tenter rails for holding material, such material having marginal edges and said securement means being adapted to hold such material substantially at such marginal edges, a first roll arranged adjacent the first end in transverse relation to the tenter rails and a second roll arranged adjacent the second end in transverse relation to the tenter rails and substantially parallel with the first roll, said method including the steps of:

a. loading an endless web of material on and between the first roll and the second roll so that the endless web of material forms a loop of such material around the first and second rolls;

b. arranging the loop of material such that a portion thereof is engaged and held by the securement means in the tentering path;

c. moving the material such that the engaged portion of material moves in a first direction from the first end to the second end, and, substantially simultaneously, driving the securement means in the first direction;

d. stopping the movement of the material; and e. moving the material such that the engaged portion of material moves in a second direction from the second end to the first end, and, substantially simultaneously, driving the securement means in the second direction.

42. The method of claim 41, wherein the loop of material has an upper flight of material and a lower pass of material between the rolls, and including the step of arranging the first roll and second roll above the tenter rails such that the lower pass of material is engaged and held by the securement means in the tentering path.

43. The method of claim 43, including the steps of providing first and second material guiding means at the first end and the second end, respectively, for guiding material at least into the tentering path by guiding the material at the first end when the material is moving in the first direction and guiding the material at the second end when the material is moving in the second direction.

44. The method of claim 43, including the step of rotating one of said first or second rolls to move the material in the first direction, and the subsequent step of rotating one of said first or second rolls to move the material in the second direction.

45. The method in claim 43, including the step of guiding the material at both the first end and the second end, regardless of the direction in which the material is being moved, by causing the first and second material guiding means to follow the marginal edges of the material at the respective first and second ends.

46. A tentering system comprising:

a. a pair of spaced tenter rails defining a first end, a second end and a tentering path between said tenter rails;

b. a pair of movable securement means carried by said tenter rails for holding materials while such materials are moved through said tentering path, such material having marginal edges and securement means being adapted to hold such material substantially at such marginal edges;

c. drive means associated with said securement means for driving said securement means;

d. material moving means for facilitating the movement of material through said tentering path, said material moving means including a head roll arranged transverse to said tenter rails at said first end and a tail roll arranged transverse to said tenter tails at said second end, said head roll and said tail roll being substantially parallel to one another and being arranged to rotate a continuous length of material such that the material moves through said tentering path, said head roll and said tail roll being arranged such that an endless web of material can be loaded on and between said rolls to form a loop of material having upper and lower substantially horizontal bands of material between said rolls, the lower band of material moving through said tentering path; and e. elevation means for raising and lowering at least said pair of tenter rails so that the distance between said head and tail rolls and said tenter rails can be varied, thereby facilitating the loading and removal of an endless web of material onto and from said rolls.

* * * * *

UNITED STATES PATENT AND TRADEMARK OFFICE

CERTIFICATE OF CORRECTION

PATENT NO. : 5,255,419

DATED : October 26, 1993

INVENTOR(S) : Stanislaw et al.

It is certified that error appears in the above-identified patent and that said Letters Patent is hereby corrected as shown below:

Column 6, line 64, "24" should read --34--

Column 6, line 64, "tail" should read --head--

Column 6, line 65, "26" should read --24--

Column 17, line 14, "43" should read --42--

Signed and Sealed this

Twenty-fourth Day of May, 1994

Bruce Lehman

BRUCE LEHMAN

*Commissioner of Patents and Trademarks*

*Attest:*

*Attesting Officer*

UNITED STATES PATENT AND TRADEMARK OFFICE

CERTIFICATE OF CORRECTION

PATENT NO. : 5,255,419
DATED : Oct. 26, 1993
INVENTOR(S) : Stanislaw et al.

It is certified that error appears in the above-indentified patent and that said Letters Patent is hereby corrected as shown below:

Col. 6, line 64, "24" should read --34--.

Col. 17, line 14, "43" should read --42--.

This Certificate supersedes Certificate of Correction issued May 24, 1994.

Signed and Sealed this

Twenty-sixth Day of July, 1994

*Attest:*

*Attesting Officer*

BRUCE LEHMAN

*Commissioner of Patents and Trademarks*